US006024155A

United States Patent [19]

Sharp

[11] Patent Number: 6,024,155

[45] Date of Patent: Feb. 15, 2000

[54] TRUCK DOORSTOP

[76] Inventor: Michael J. Sharp, 996 Bayside Cove W., Newport Beach, Calif. 92660

[21] Appl. No.: 09/026,499

[22] Filed: Feb. 19, 1998

[51] Int. Cl.[7] ..... E05D 15/06

[52] U.S. Cl. ..... 160/201; 160/209; 296/50

[58] Field of Search ..... 160/201, 209; 296/50, 146.8, 106

[56] References Cited

U.S. PATENT DOCUMENTS

| | | | |
|---|---|---|---|
| 1,621,669 | 3/1927 | Johnson | 160/209 |
| 2,045,060 | 6/1936 | Wheatley | 160/209 |
| 2,066,558 | 1/1937 | Dautrick | 160/209 |
| 5,429,170 | 7/1995 | Nogaki | 160/201 |

*Primary Examiner*—Blair M. Johnson

*Attorney, Agent, or Firm*—Walter A. Hackler

[57] ABSTRACT

A truck trailer door safety door stop is provided for preventing a truck trailer door from accidentally falling closed. The door stop may be retrofitted onto a conventional truck trailer door of the roll up type including a plurality of hinged panels which ride along rails by means of roller wheels. The door stop includes a glide member for guiding a bottom panel of the roll up door along the rail without engagement therewith. When the door is in a fully opened position, the disengaged bottom panel is pulled out of alignment with the rail and separated therefrom by means of a spring. In response to a sudden forward movement of the truck, which would normally cause such a door to accidentally close, the door will be forced directly rearward and be prevented from falling down the rail. A guide bar may be provided for supporting the bottom panel in a positive lock open position.

8 Claims, 3 Drawing Sheets

TRUCK DOORSTOP

The present invention generally relates to a truck doorstop, and more specifically relates to a safety device for a truck door of the roll up type for preventing the door from inadvertently closing upon an impact or sudden motion of the truck.

Cargo truck trailer design may include a rear door of the roll up type which includes a plurality of hinged panels having rollers riding inside a pair of rails.

Fatal accidents and serious injury have occurred as a result of such trailer doors inadvertently falling closed upon a person, for example, a person who is loading cargo into the truck. Although a spring mechanism is usually provided for holding the door open until one purposefully pulls the door downward, the spring mechanism is often broken or fatigued, particularly with regard to older trailers. In such a case, any abrupt jarring motion of the truck may cause the heavy door to roll downward along the rail toward a closed position, striking the head of any person who may be in the path of the door. An even more common occurrence relating to head injuries is when the door is shoved forward and down the rail after being struck by a high load of cargo being unloaded from the trailer.

Simple measures may be taken to prevent the inadvertent closing of these large trailer doors in the event the spring becomes damaged or is missing. For example, a rope or a more sophisticated latch may be provided for enabling the door to be positively secured in an open position. Unfortunately, such safety devices are not always available and even in the event that they are available, the devices are not used consistently, in the interest of saving time. In other instances, the safety rope or latch may be worn, broken, rusted, or difficult to operate.

What is needed then is a safety device for a truck door which requires no positive action from the user to operate but is caused to engage every time the truck door is opened. Such a safety device is needed which will not become inoperable due to corrosion or breakage under heavy usage. The present invention provides such a device with the objective of saving lives and preventing serious injury. Advantageously, the device can be easily retrofitted onto existing truck trailers at minimal expense.

SUMMARY OF THE INVENTION

Accordingly, an improved truck trailer safety door is provided. The improvement may comprise a truck doorstop that can be easily retrofitted onto existing trailer doors of the roll up type. The doorstop is designed to prevent a truck trailer door from accidentally closing which could cause serious or fatal injury to a person. Advantageously, the present invention does not require a user to manually lock or latch the door in an open position. The door stop will become automatically engaged upon normal opening of the door, and will become disengaged by an easy pull thereon.

Particularly, a truck trailer safety door in accordance with the invention generally comprises a roll up door of the conventional type in combination with the novel doorstop. In order to clarify the present invention, a conventional roll up truck trailer door will now be briefly described, although such doors are well known in the art. The conventional roll up door generally includes a plurality of horizontally disposed panels that are hinged together, and a pair of rails for guiding the hinged panels upon opening and closing of the door. The rails are disposed vertically along side panels of the truck trailer and curve into a horizontal position along the upper interior surface of the trailer. Rollers or other suitable means are secured to each of the panels, for movably engaging the hinged panels with the rails. The door may be lifted open and pulled closed by manually rolling the panels up and down the rails. In a fully opened position, the hinged panels are disposed horizontally along the horizontal portion of the rails. It will be understood by those skilled in the art that such a roll up door as hereinabove briefly described is well known in the art.

Such a truck trailer door may be quite massive. In order to make such a door easy to lift, the wheels roll freely along the rails to which they are engaged. To compensate for the free rolling wheels on the heavy door, and allow better control of the door, a spring may be provided for counterbalancing the weight of the heavy door while the door is manually pulled up or down along the rails.

The door of a large trailer truck is thrust rearward along the rails upon a sudden forward motion of the truck or upon being pushed by a high load being unloaded from the trailer. When the spring mechanism is worn, the door will begin to roll down the rail and will rapidly accelerate. This immediately presents an extremely dangerous situation for any person in the path of the falling door. In some situations, the spring mechanism is missing or nonfunctional and thus even a slight motion of the truck, or a moderate push on the door may cause the door to accidentally fall.

The door stop of the present invention generally comprises a glide member secured to a bottom panel of the door. For purposes of retrofitting an existing trailer door, the glide member will replace a roller wheel which usually engages the bottom panel to the rail. The glide member provides means for guiding the bottom panel of the door along the rail without engagement between the bottom panel and the rail. The remaining hinged panels of the door are engaged to the rail by means of the remaining roller wheels fitted inside the rails.

By replacing the bottom set of roller wheels with the doorstop of the present invention, the bottom panel of the door will become misaligned from the rail when the door is in the fully opened position above the arcuate portion in the rail. Thus, upon a sudden motion of the truck, particularly a sudden forward motion of the truck, the bottom panel of the door will rush rearward without dropping below the arcuate portion of the rail.

In addition to the glide member, the door stop of the present invention may include a glide track, disposed above the curve of the rail, for supporting the bottom panel and positively locking the door open in response to a sudden rearward motion of the door. In order to disengage the door from the positive lock position, an easy forward pull on the bottom panel and a downward pull along the rail is all that is required.

BRIEF DESCRIPTION OF THE DRAWINGS

The advantages of present invention will be more readily understood with respect to the following Detailed Description when considered in conjunction with the accompanying Drawings of which.

DETAILED DESCRIPTION

Figure 1:
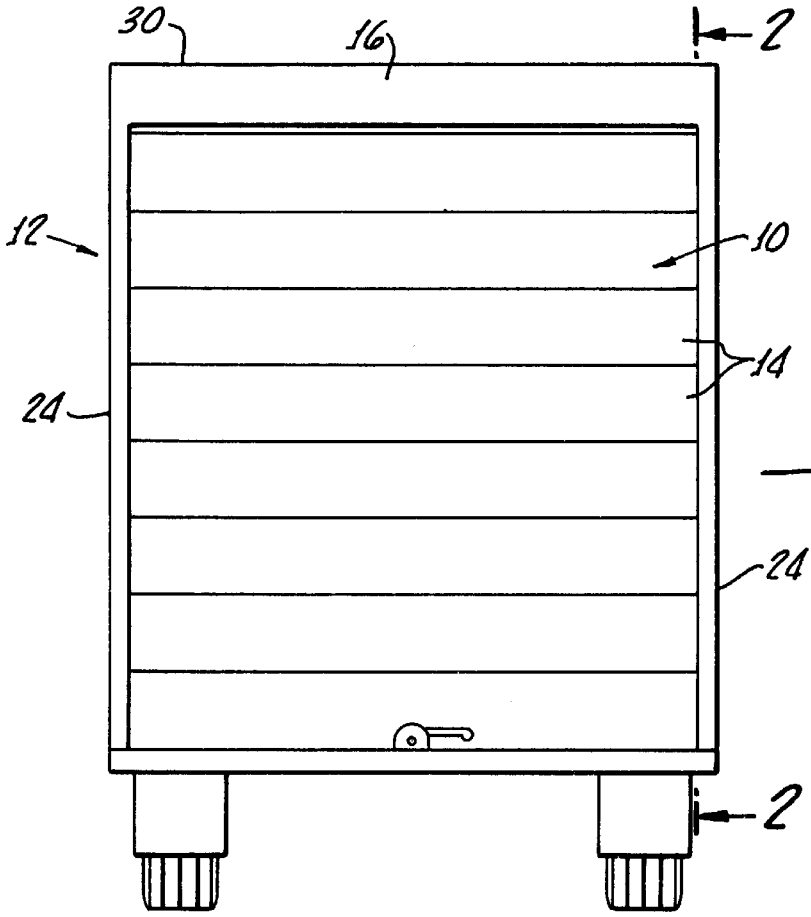
FIG. 1 shows a front view of a truck trailer safety door, in accordance with the present invention, the safety door comprising a plurality of hinged panels rollably attached to rails inside the trailer.

Turning now to FIG. 1, an improved truck trailer door 10 in accordance with the present invention is shown, as viewed toward a back end of a truck trailer 12. The door 10 comprises generally a plurality of horizontally disposed panels 14 that may be hinged or otherwise coupled together such that the door 10 may be rolled up into a top of the trailer 12 when the door 10 is opened. As conventional, the truck trailer 12 includes a back overhang 16, the importance of which will later become apparent.

Figure 2:
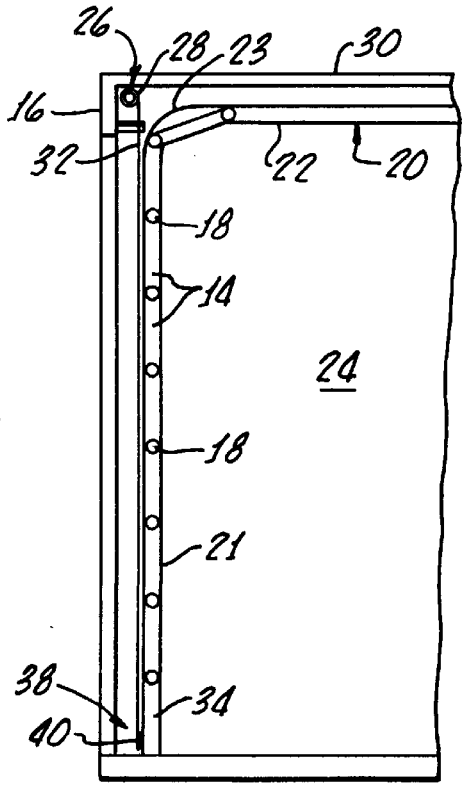
FIG. 2 shows a cross-sectional view of the safety door taken along line 2—2 of FIG. 1, showing a bottom panel including a doorstop, in accordance with the invention, for preventing accidental closing of the door, and each of the remaining panels including roller wheels.

Turning now also to FIG. 2, each panel 14 of the door 10 includes peripheral roller wheels 18 secured thereto. A rail 20 is provided on each of two sides 24 (only one of the sides 24 are shown in FIG. 2) of the trailer 12 to engage the roller wheels 18 and allow the panels 12 to be rolled up and down the rail 20 during opening and closing of the door 10. The rail 20 may be considered to include a vertical section 21, a horizontal section 22 and an arcuate portion 23 therebetween. When he door is in a closed position, such as shown in FIGS. 1 and 2, the door is positioned along the vertical section 21. Likewise, when the door is in a fully opened position (not shown in FIGS. 1 or 2) the door is positioned along the horizontal section 22 above the arcuate portion 23.

A spring mechanism 26, including a wound spring 28 spanning a width of a trailer top surface 30, in conjunction with a cable 32 secured from the spring mechanism 26 to a bottom panel 34 of the door 10 may be provided for biasing or counterbalancing the door 10 in order to facilitate opening and closing of the door 10. It will be appreciated by those familiar with truck trailers that such roll up doors as hereinabove just described are well known.

Importantly, the trailer door 10 of the present invention comprises the roll up door 10 as hereinabove described with the improvement of a doorlock 38 for preventing the door 10 from accidentally closing or rolling down the rail 20 once it has been raised to a fully opened position. The doorlock 38 of the present invention provides a simple mechanism for preventing the accidental door closure, and will be more clearly understood with respect to FIGS. 3–6.

Figure 3:
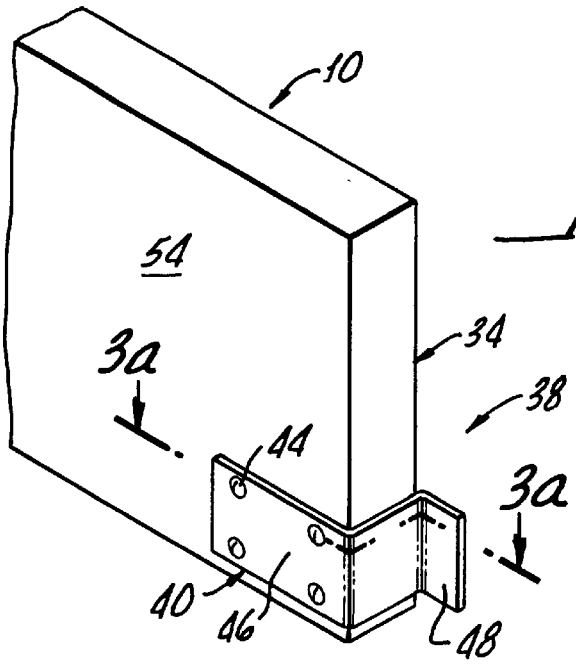
FIG. 3 shows perspective view of the bottom panel of the truck trailer safety door including the doorstop.
Figure 3A:
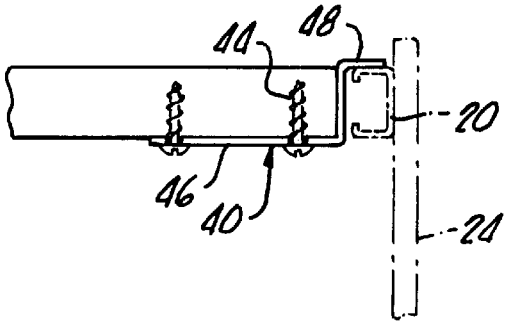
FIG. 3*a* shows a cross sectional view of the bottom panel and doorstop taken along line 3*a*–3*a* of FIG. 3, the doorstop comprising glide means for guiding the bottom panel along the rail while preventing engagement therebetween.

The doorlock 38 generally includes a glide member 40, shown in FIGS. 2, 3 and 3*a*, for guiding the bottom panel 34 along the rail 20 without engagement therewith. The remaining panels are rollably engaged to the rails 20 by means of the roller wheels 18, such as shown in FIG. 2. The rail 20 provides means for guiding the panels 14 between a door open position and a door closed position. Furthermore, in accordance with the invention, the glide member 40 enables the spring mechanism 26 to separate the bottom panel 34 from the rail 20 when the door is lifted to an open position.

Figure 4:
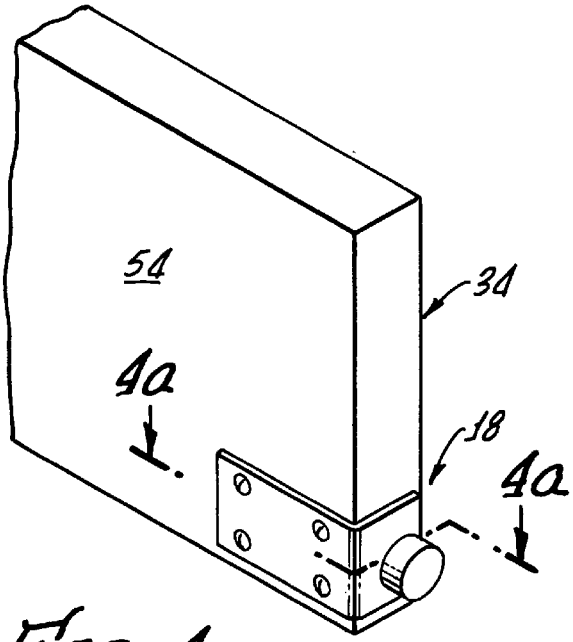
FIG. 4. (PRIOR ART)
FIG. 4 shows a perspective view of a bottom panel of a prior art truck trailer door including a roller wheel for engaging a rail.
Figure 4A:
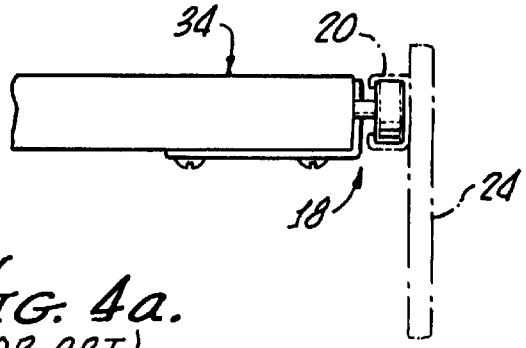
FIG. 4a. (PRIOR ART)
FIG. 4*a* shows a cross-sectional view of the bottom panel and roller wheel, taken along line 4*a*–4*a* of FIG. 4.

The present invention may be easily retrofitted to a conventional truck trailer door. FIGS. 4 and 4*a* show a conventional trailer roll up door, particularly a bottom panel 54 thereof before it has been retrofitted with the doorstop 38 of the present invention. In the conventional trailer door, each panel 14, including the bottom panel 34 is secured to the rail 20 by means of a set of roller wheels 18 which allow the door to be raised and lowered by simply manually moving the door 10 along the rail 20. To install the doorstop 38 of the present invention on the conventional trailer door, the roller wheel 18 is removed from the bottom panel 34 and replaced with the glide member 40, as shown in FIG. 3 and 3*a*. Thus, with the improved door 10 of the present invention, the bottom panel 34 is not engaged with the rail 20 such as shown in FIG. 4*a*, but is instead guided along the rail 20 by the glide member 40 as shown in FIG. 3*a*.

The glide member 40 includes a plate portion 46 and an integral extended portion 48 which allows the panel 34 to slide freely along the rail 20 as the door is lifted open and pulled closed. Because it extends between the panel 34 and the rail 20 (see FIG. 3*a*), the glide member 40 prevents the bottom panel 34 from slipping into and engaging the rail 20. The glide member 40 may be installed by any suitable means, such as screws 52, preferably to an inside surface 54 of the truck trailer door 10 to prevent the bottom panel 38 from swinging inward.

Figure 5:
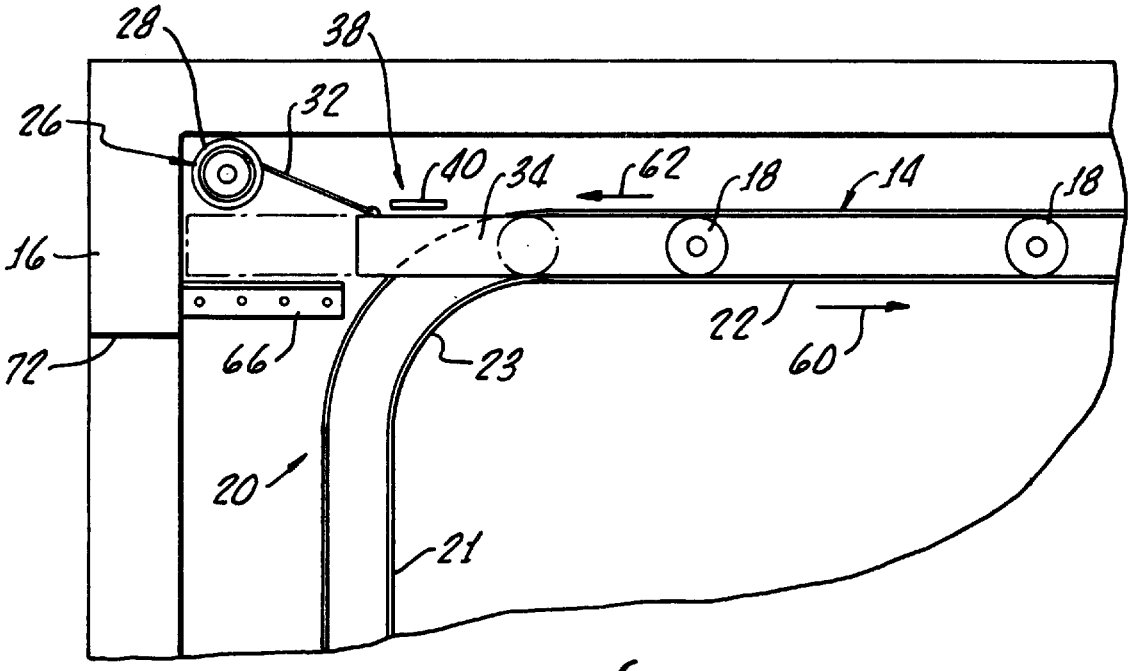
FIG. 5 shows a diagrammatically view of the safety door of the present invention as the door is in a fully opened position along a top of the truck trailer and the bottom panel has been disengaged from the rail by the glide means, preventing accidental falling of the door down the rail; phantom line indicates the door urged into a positive lock position due to a sudden motion of the truck.

FIG. 5 shows the door 10 in accordance with the invention in a fully opened position along the horizontal section 22 of the rail 20. As shown, the bottom panel 34 is misaligned with the rail 20, specifically the arcuate portion 23, when the door 10 is in the open position. The spring 28 may provide means for lifting the bottom panel 34 out of alignment when the door 10 has been opened.

Figure 6:
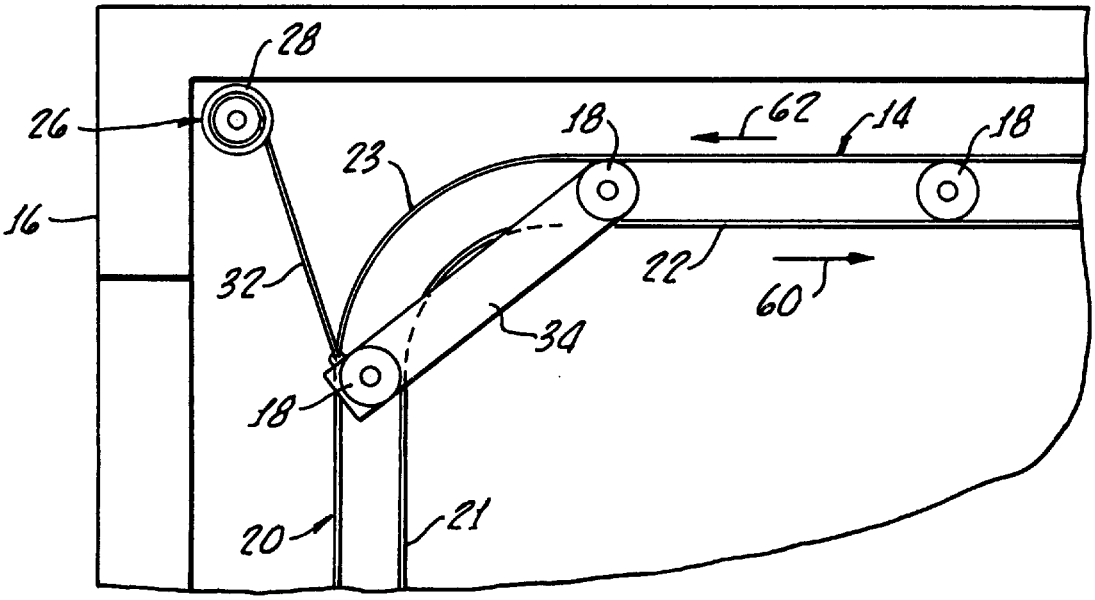
FIG. 6. (PRIOR ART)
FIG. 6 shows a diagrammatically view of a conventional truck trailer door having roller wheels on the bottom panel, as the door is in the fully opened position along a top of a truck trailer and the door is beginning to accidentally drop down the rail due to a sudden motion of the truck.

To better understand the safety advantage of the present invention, FIG. 5 may be compared to FIG. 6. FIG. 6 shows a conventional door not fitted with the present invention. Upon a motion of the truck, particularly a sudden forward motion in the direction indicated by arrow 60 in both FIG. 5 and 6, or upon being directly contacted and pushed forward, for example by high loads in the trailer, the roll up door will naturally be forced toward the rear of the truck, in the direction of arrow 62. Although the spring mechanism 26 is designed to bias the door in the open position, without the doorstop 38 of the present invention, the door will be urged down the rail 20 since that the only path available for travel. If the motion is sufficiently strong or the spring mechanism 26 is worn or missing, the door will rapidly accelerate down the rail 20 under its own weight. It is known that motion that could cause such a door to fall may be a result of a sudden rear impact with a nearby vehicle, a impact caused by the person loading or unloading the trailer with heavy cargo, or even a strong wind. As discussed above, this presents an extremely dangerous situation for any person standing in the path of the falling door. Understandably, most injuries resulting from this situation are to the head.

FIG. 5 shows how the present invention may be used to prevent the door from accidentally falling down the rail 20. In response to a motion of the trailer in the direction of arrow 60, the door will again be urged rearward in the direction of arrow 62. However, by replacing the bottom roller wheel on the door 10 in FIG. 6 with the glide member 40, the bottom panel 34 being disengaged from the rail 20, will be urged horizontally, out of alignment with the rail arcuate portion 23 as shown. More particularly, rather than moving in a downward direction dictated by the rail path (such as shown in FIG. 6), the safety door 10 will travel directly toward the overhang 16. As shown in phantom line, in response to a sufficiently strong thrust, the door 10 will be forced to collide with the back overhang 16 but will not be pushed down the rail 20.

When the doorstop 38 is retrofitted onto an existing trailer door 10, even a worn spring mechanism 26 will usually provide enough pull to lift the bottom panel 34 upward above the arcuate portion in the rail 20. This is particularly true if the size and material used for the glide member 40 are selected to result in very lightweight glide member 40. If no spring mechanism 26 is available in the trailer to be retrofitted, a spring 28 may be installed in a suitable location, said spring having sufficient resistance to lift the bottom panel into a horizontal alignment when the door is opened. For lightweight doors, a spring may not be necessary.

Referring still to FIG. 5, the doorstop 38 of the present invention may also include means, such as a guide track 66, for supporting the bottom panel 34 in a horizontal position and out of alignment with the rail 20. More particularly, the guide track 66 may comprise a metal bar having an L-shaped cross section which is secured by suitable means to the interior 24 of the trailer 12 adjacent the rail arcuate portion 23. The glide track 66 is installed just above a lower edge 72 of the overhang so as to guide the door 10 toward the overhang when the door 10 is forced rearward.

Upon a rearward motion of the door 10 in the direction of arrow 62, the bottom panel 34 will slide and come to a rest horizontally, supported by the guide track 66 as shown in phantom line of FIG. 5. Notably, it can be seen that the more forceful the forward thrust of the trailer 12 in the direction of arrow 60, the more positively the door becomes locked open by the doorstop 38.

In order to disengage the door from the doorstop 38, a user needs only pull the door 10 forward out of the glide track 66 and then lower the door as usual along the rail 20.

Although there has been hereinabove described a truck doorstop, in accordance with the present invention, for purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the present invention as defined in the appended claims.

What is claimed is:

1. In a roll up truck trailer door having a plurality of panels, peripheral roller wheels and a rail for engaging and guiding the roller wheels upon opening and closing of the door, an improvement comprising:

glide means, comprising a plate member disposed on a bottom panel of the door and adapted to be slidably seated against the rail for guiding the bottom panel along the rail when the door is moved between a vertical closed position and a horizontal open position; and means for preventing inadvertent door closure, including a spring mechanism connected to the bottom panel and biased for causing separation and misalignment of the bottom panel with the rail when the door is in the horizontal open position.

2. The improved truck trailer door according to claim 1 wherein the means for preventing inadvertent door closure further includes guide track means for supporting the door in the horizontal open position and preventing the bottom panel from dropping into vertical alignment with the rail.

3. The improved truck trailer door according to claim 2 wherein the spring mechanism is biased to lift the bottom panel into parallel alignment with the guide track means in order to cause the bottom panel to slide onto the guide track means in response to a impact exerted against the door.

4. A truck trailer safety door comprising:

a roll up door including a plurality of interconnected upper panels and a bottom panel;

rail means for guiding the panels between a horizontal open position and a vertical closed position;

roller means, including wheels mounted to the upper panels and adapted to both engage and travel along the rail means, for facilitating opening and closing of the door;

glide means, comprising a plate member disposed on the bottom panel of the door and adapted to be slidably seated against the rail, for guiding the bottom panel along the rail when the door is moved between the vertical closed position and the horizontal open position; and means for preventing inadvertent door closure, including a spring mechanism connected to the bottom panel and biased for causing separation and misalignment of the bottom panel with the rail when the door is in the horizontal open position.

5. The truck trailer safety door according to claim 4 further comprising guide track means for supporting the door in the horizontal open position and preventing the bottom panel from dropping into vertical alignment with the rail.

6. Doorstop apparatus in a roll up truck trailer door having a plurality of panels, peripheral roller wheels and a rail for engaging and guiding the roller wheels between a horizontal open position and a vertical closed position, said door stop apparatus comprising:

glide means, comprising a plate member disposed on a bottom panel of the door and adapted to be slidably seated against the rail, for guiding the bottom panel of the door when the door is moved between a vertical closed position and a horizontal open position; and means for preventing inadvertent door closure, including a spring mechanism connected to the bottom panel and biased for causing separation and misalignment of the bottom panel with the rail when the door is in the horizontal open position.

7. The doorstop apparatus according to claim 6 wherein the means for preventing inadvertent door closure further includes guide track means for supporting the door in the horizontal open position and preventing the bottom panel from dropping into vertical alignment with the rail.

8. The doorstop apparatus according to claim 6 wherein the spring mechanism is biased to lift the bottom panel into parallel alignment with the guide track means in order to cause the bottom panel to slide onto the glide track means in response to a jarring motion exerted on the door.

* * * * *